US007455364B1

(12) United States Patent
Lin et al.

(10) Patent No.: US 7,455,364 B1
(45) Date of Patent: Nov. 25, 2008

(54) LEG FRAME OF CHAIR HAVING DECORATION STRIP ENGAGED THEREIN

(76) Inventors: Mei Chuen Lin, 9F, No. 275-1, Yuan-Hua Road, Chung-Li City, Taoyuan Hsien (TW); Tzu Mei Wang, 9F, No. 275-1, Yuan-Hua Road, Chung-Li City, Taoyuan Hsien (TW)

( * ) Notice: Subject to any disclaimer, the term of this patent is extended or adjusted under 35 U.S.C. 154(b) by 0 days.

(21) Appl. No.: 11/875,833

(22) Filed: Oct. 20, 2007

(51) Int. Cl.
*A47C 7/02* (2006.01)

(52) U.S. Cl. ..... 297/452.38

(58) Field of Classification Search ..... 297/463.1, 297/463.2, 452.18, 452.38, 56; 248/345.1; 40/320; 16/404
See application file for complete search history.

(56) References Cited

U.S. PATENT DOCUMENTS 1,873,768 A * 8/1932 Kux ..... 297/56
2,547,239 A * 4/1951 Walker ..... 40/647
3,318,061 A * 5/1967 Stentz ..... 52/288.1
4,106,739 A * 8/1978 Gasser ..... 248/345.1
4,262,871 A * 4/1981 Kolk et al. ..... 248/188.7
4,710,992 A * 12/1987 Falwell et al. ..... 5/663
5,160,105 A * 11/1992 Miller ..... 248/188.9
D463,261 S * 9/2002 Ursini et al. ..... D8/402
6,502,899 B2 * 1/2003 Tseng ..... 297/28
7,052,083 B2 * 5/2006 Peitz et al. ..... 297/183.1

* cited by examiner

*Primary Examiner*—Milton Nelson, Jr.

(57) ABSTRACT

A leg frame of a chair having a decoration strip engaged therein includes the leg frame and the decoration strip. The leg frame includes a frame base, two curved ridges respectively disposed at both edges of the frame base, and an engaging groove formed between the frame base and the curved ridges. An inner lower side of each curved ridge is slanted to form an acute corner between the frame base and the curved ridge. The decoration strip corresponding to the engaging groove is fitted in the engaging groove. The decoration strip includes a bottom surface, two concave side surfaces, and two extended ribs respectively disposed between the bottom surface and the side surfaces. When the decoration strip is engaged with the leg frame, the ribs are respectively engaged with the acute corners and the side surfaces are respectively in contact with the curved ridges.

1 Claim, 6 Drawing Sheets

LEG FRAME OF CHAIR HAVING DECORATION STRIP ENGAGED THEREIN

BACKGROUND OF THE INVENTION

1. Field of the Invention

The present invention relates to a leg frame of a chair, and in particular to a leg frame of a folding chair having a decoration strip engaged therein. The decoration strip takes advantage of geometric configuration and elasticity to be engaged between two curved ridges of the leg frame, and therefore does not need adhesive to be securely fixed in place.

2. The Prior Arts

A conventional chair, especially a folding chair uses a decoration strip engaged in the chair frame to enhance the aesthetics and quality. The folding chair includes a U-shaped front leg frame and a rear leg frame pivotally connected with each other. The front and rear leg frames can be folded to make the chair in a closed state and can be unfolded to make the chair in an open state. An inner side of a middle section of the front leg frame is pivotally connected with a seat. A backrest is mounted in a top section of the front leg frame. The decoration strip is engaged with the leg frame.

Referring to FIGS. 1A and 1B, a leg frame A includes a continuous frame base A1 and two curved ridges A2 respectively disposed at both edges of the frame base A1. The frame base A1 and the curved ridges A2 are integrally formed as one piece. FIG. 1A shows the cross sectional view taken from the plane which is cut through by the broken line designated by 1A-1A shown in FIG. 1B. The exploded view of the leg frame A and the decoration strip B is labeled C and shown in FIG. 1B. The cross section of the curved ridge A2 is in an arch shape. The inner lower side of the curved ridge A2 close to the frame base A1 is slanted toward a center line of the frame base A1. The angle between the frame base A1 and the curved ridge A2 is obtuse. A continuous engaging groove is formed between the frame base A1 and the curved ridges A2 for receiving a corresponding decoration strip B. The decoration strip B includes a top surface B1, a bottom surface B2 and two slightly curved side surfaces B3. Adhesive is applied on the bottom surface B2 and the side surfaces B3 of the decoration strip B, and then the decoration strip B is stuck into the engaging groove. Because the shape of the decoration strip B is the same as that of the engaging groove, the side surfaces B2 is closely contacted with the curved ridges A2 of the leg frame A. Therefore, the decoration strip B is engaged with the leg frame A.

However, the sticking of the decoration strip B has the following disadvantages. First of all, the adhesive is not applied evenly on the decoration strip B, and therefore part of the decoration strip B is warped and disengaged from the engaging groove of the leg frame. Secondly, the adhesive gradually deteriorates after a long time use, and the decoration strip B falls off the leg frame A. Because the shape of the decoration strip B is corresponding to that of the engaging groove, the side surfaces B2 closely contact with the curved ridges A2 of the leg frame A. Therefore, the decoration strip B is engaged with the leg frame A.

SUMMARY OF THE INVENTION

A primary objective of the present invention is to provide a leg frame of a folding chair having a decoration strip, which overcomes the disadvantage of the conventional design that the decoration strip may easily fall off the leg frame. Accordingly, the decoration strip of the present invention is securely fixed with the leg frame of the folding chair using an engagement method to replace the conventional adhesive method.

Another objective of the present invention is to provide a configuration of a leg frame and a corresponding decoration strip, which can quickly engage the decoration strip with the leg frame.

A front leg frame of a folding chair is essentially U shaped and includes a frame base and two symmetrical curved ridges. The curved ridges are disposed at both edges of the frame base, respectively. The inner lower side of the curved ridge close to the frame base is slanted away from a center line of the frame base. The angle between the frame base and each curved ridge is acute, and an acute corner is formed between the frame base and each curved ridge. A continuous engaging groove is formed between the frame base and the curved ridges for receiving a decoration strip. The shape of the decoration strip is the same as that of the engaging groove. The decoration strip includes a bottom surface and two concave side surfaces. The decoration strip includes two extended ribs disposed between the bottom surface and the two concave side surfaces, respectively.

When assembling the decoration strip, the decoration strip is fitted into the engaging groove, the concave side surfaces of the decoration strip are tightly contacted with the curved ridges of the front leg frame, and the ribs are engaged with the acute corners. Thus, elasticity of the decoration strip will securely engage the decoration strip with the engaging groove.

The leg frame of the chair having the decoration strip engaged therein has the following advantages. First of all, the ribs are fitted in the acute corners and the curved ridges prevent the ribs from being disengaged from the acute corners. The curved ridges are tightly contacted with the concave side surfaces of the decoration strip, and therefore the decoration strip will not be disengaged from the front leg frame easily.

Secondly, the decoration strip is engaged with the leg frame. Elasticity of the decoration strip makes the decoration strip tightly fitted in the engaging groove of the leg frame. The engagement method is more convenient and quicker to assemble the decoration strip with the leg frame than the conventional adhesive method.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1A:
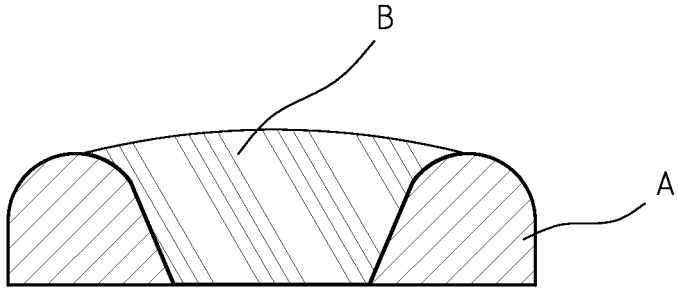
FIG. 1A (PRIOR ART)
FIG. 1A is a cross sectional view showing a conventional leg frame of a folding chair and a decoration strip engaged therein.
Figure 1B:
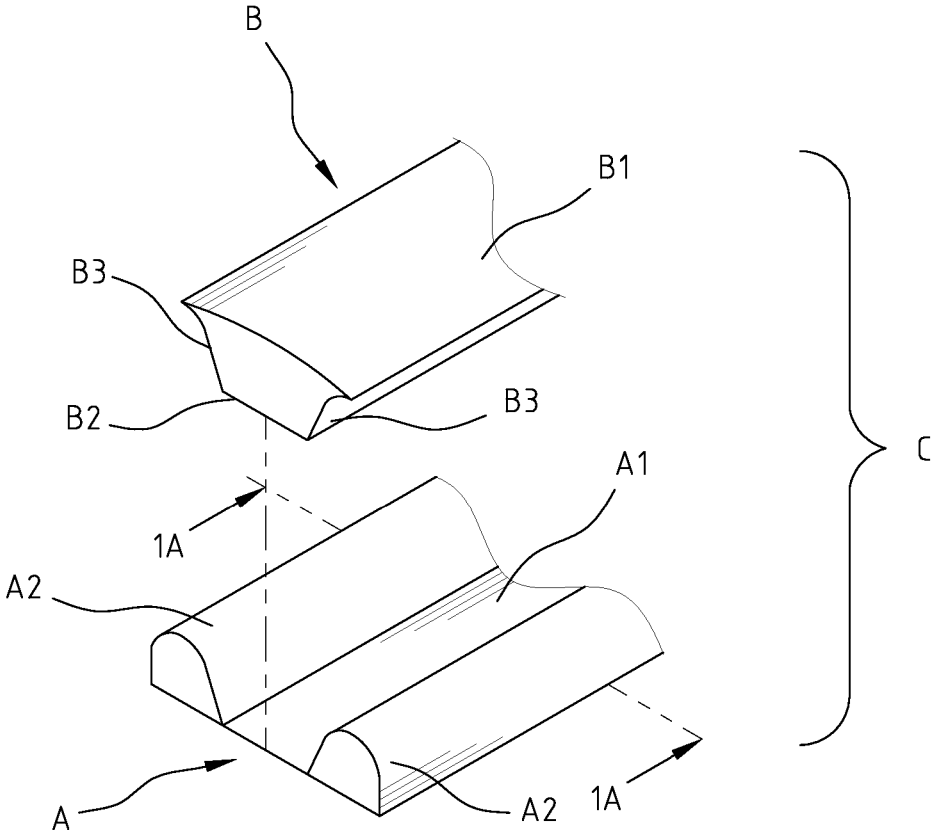
FIG. 1B (PRIOR ART)
FIG. 1B is an exploded view showing the conventional leg frame and the conventional decoration strip.
Figure 2:
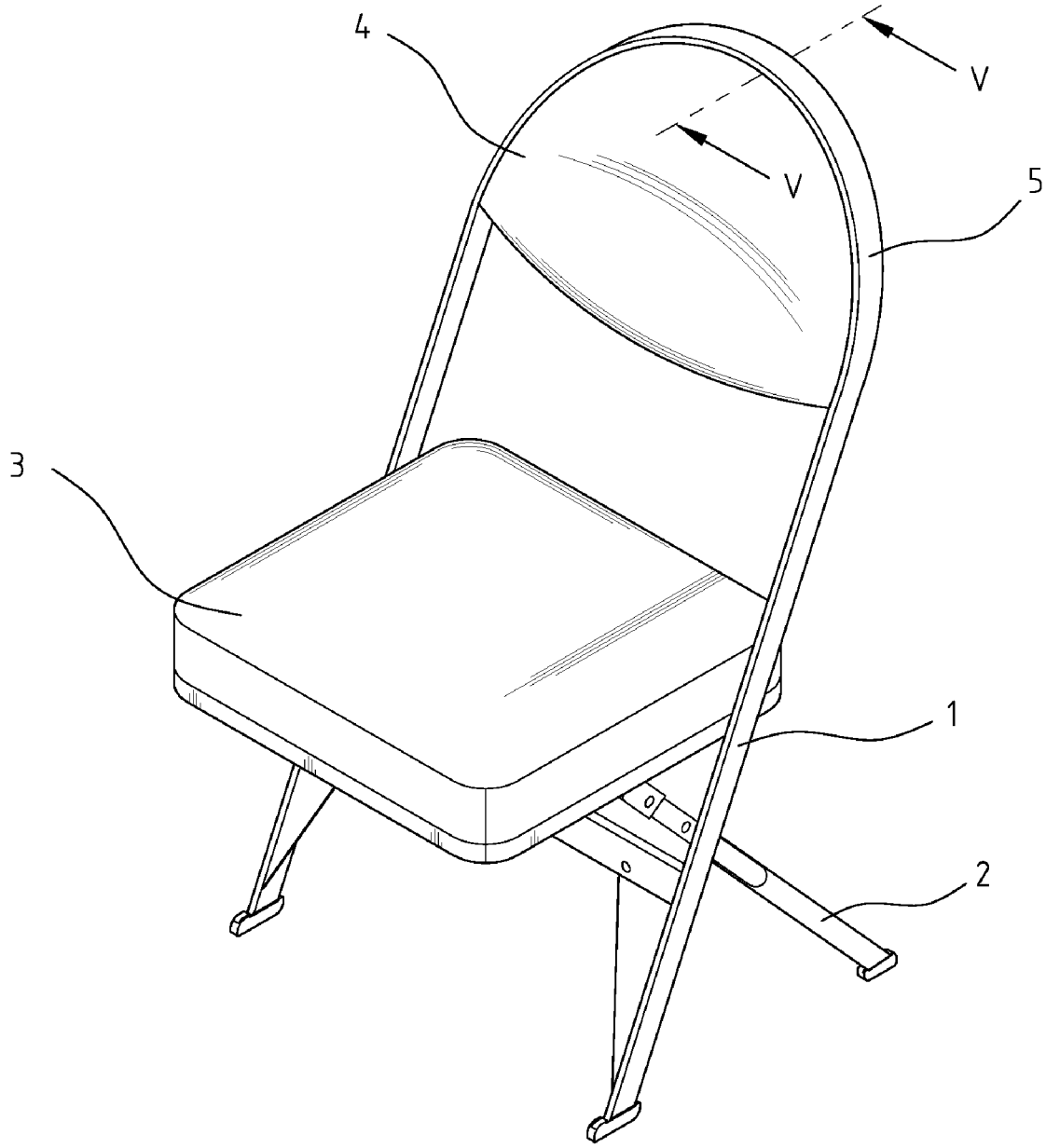
FIG. 2 is a perspective view showing a folding chair having a front leg frame and a decoration strip engaged therein in accordance with the present invention.

A leg frame having a decoration strip engaged therein according to the present invention is adaptable to a variety of chairs. The leg frame according to an embodiment of the present invention as shown in FIGS. 2-5 is adaptable to a front leg frame of a folding chair. Referring to FIG. 2, a folding chair includes an essentially U-shaped front leg frame 1, a rear leg frame 2 pivotally connected with the front leg frame 1, a seat 3 pivotally connected with an inner side of a middle section of the front leg frame 1, and a backrest 4 mounted in a top section of the front leg frame 1. The front leg frame 1 and the rear leg frame 2 can be unfolded to stand on floor or be folded for storage. The front leg frame 1 having a decoration strip 5 engaged therein according to the present invention provides the chair with aesthetics.

Figure 2A:
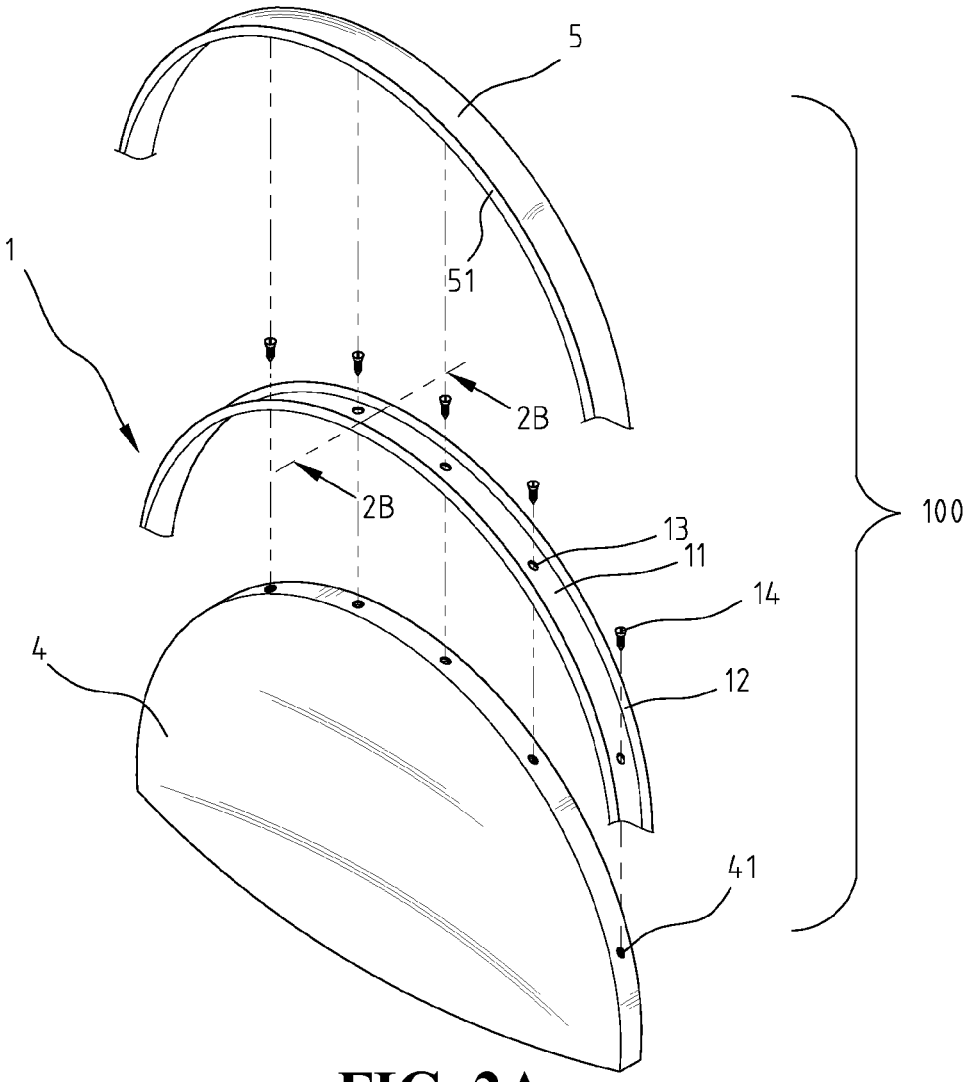
FIG. 2A is an exploded view showing a backrest, the front leg frame and the decoration strip in accordance with the present invention.
Figure 2B:
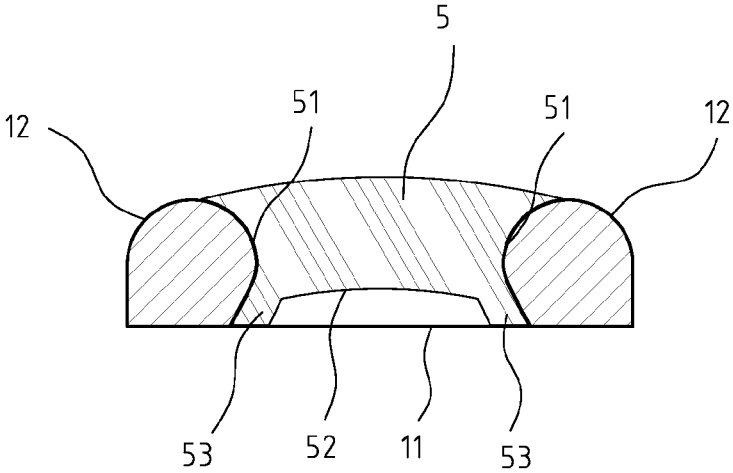
FIG. 2B is a cross sectional view showing the front leg frame and the decoration strip in accordance with the present invention.
Figure 3:
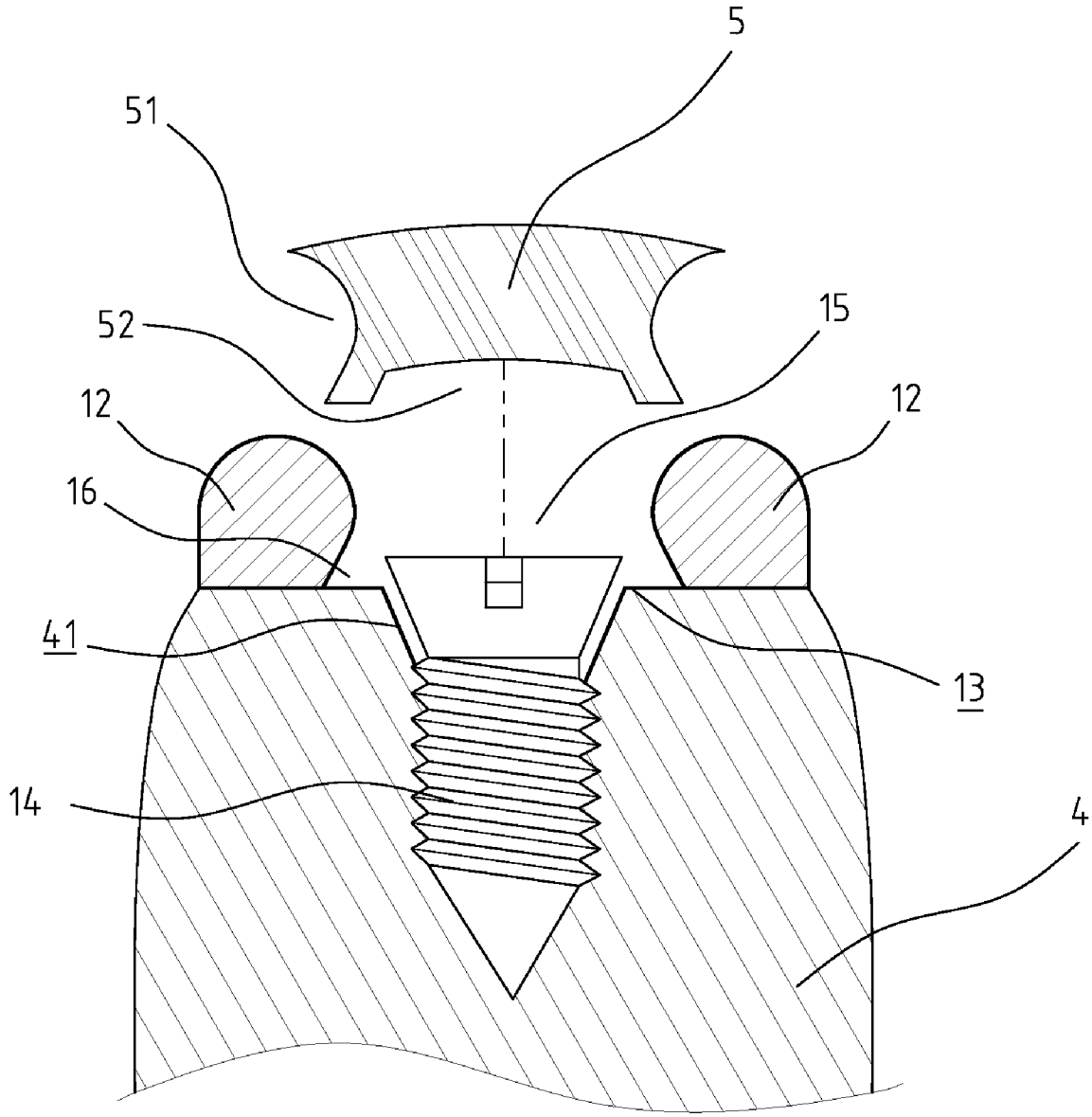
FIGS. 3-5 are cross sectional views showing a sequence of assembling the decoration strip with the front leg frame.

Referring to FIGS. 2A, 2B and 3, the front leg frame 1 includes a continuous frame base 11 and two symmetric curved ridges 12. FIG. 2A shows an exploded view 100 for the assembly of the backrest 4 and the decoration strip 5. FIG. 2B shows the cross sectional view taken from the plane which is cut through by the broken line designated by 2B-2B shown in FIG. 2A. The curved ridges 12 are disposed at both edges of the frame base 11, respectively. An engaging groove 15 is formed between the frame base 11 and the curved ridges 12. The frame base 11 and the curved ridges 12 are integrally formed as one piece. An inner lower side of the curved ridge 12 close to the frame base 11 is slanted away from a center line of the frame base 11. An angle between the frame base 11 and each curved ridge 12 is acute, thereby forming an acute corner 16 between the frame base 11 and the curved ridge 12. An upper section of the front leg frame 1 includes a plurality of holes 13 for assembling with the backrest 4. The shape of the decoration strip 5 is the same as that of the engaging groove 15. The decoration strip 15 includes a bottom surface 52, two concave side surfaces 51, and two extended ribs 53 respectively disposed between the bottom surface 52 and the two concave side surfaces 51.

Figure 4:
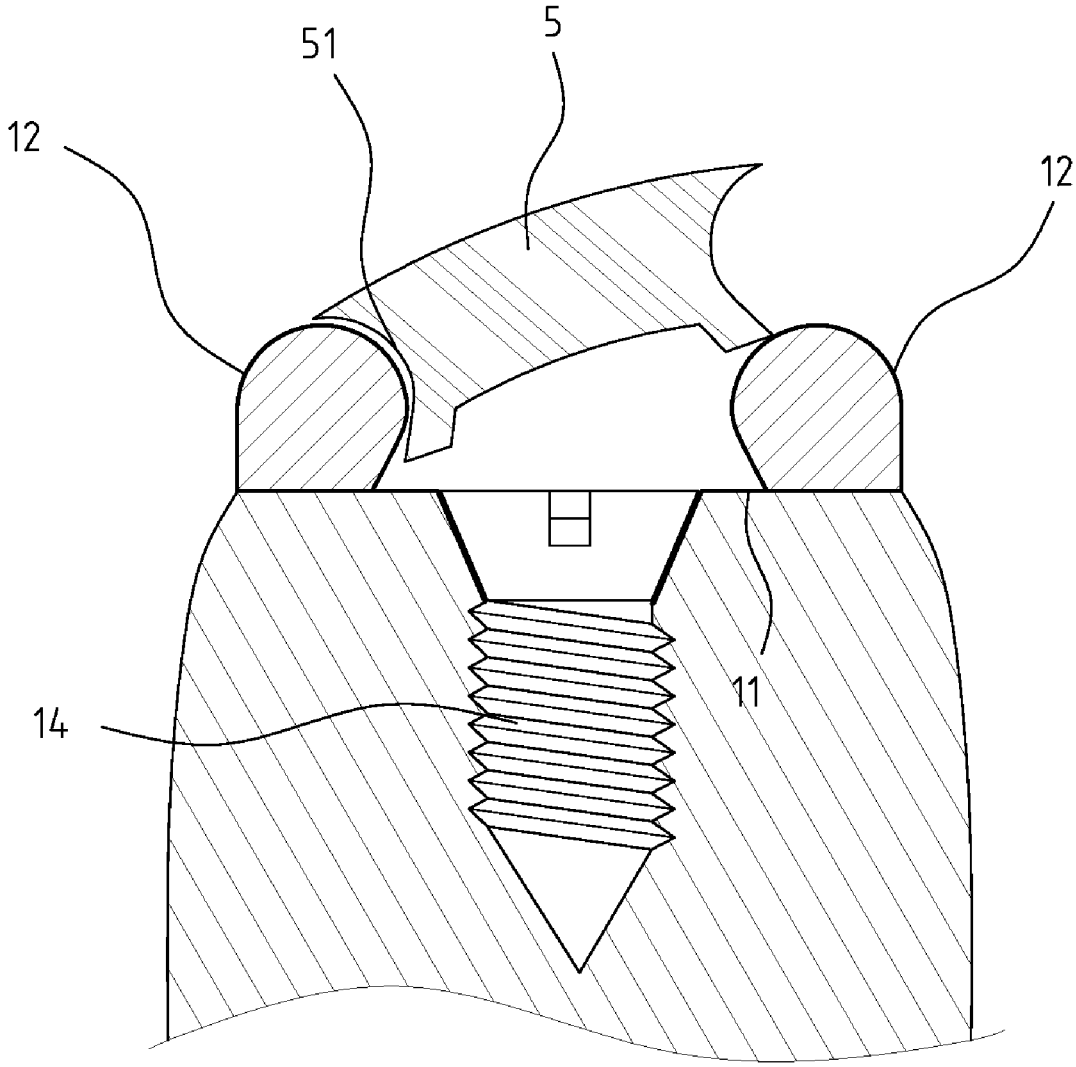
Figure 5:
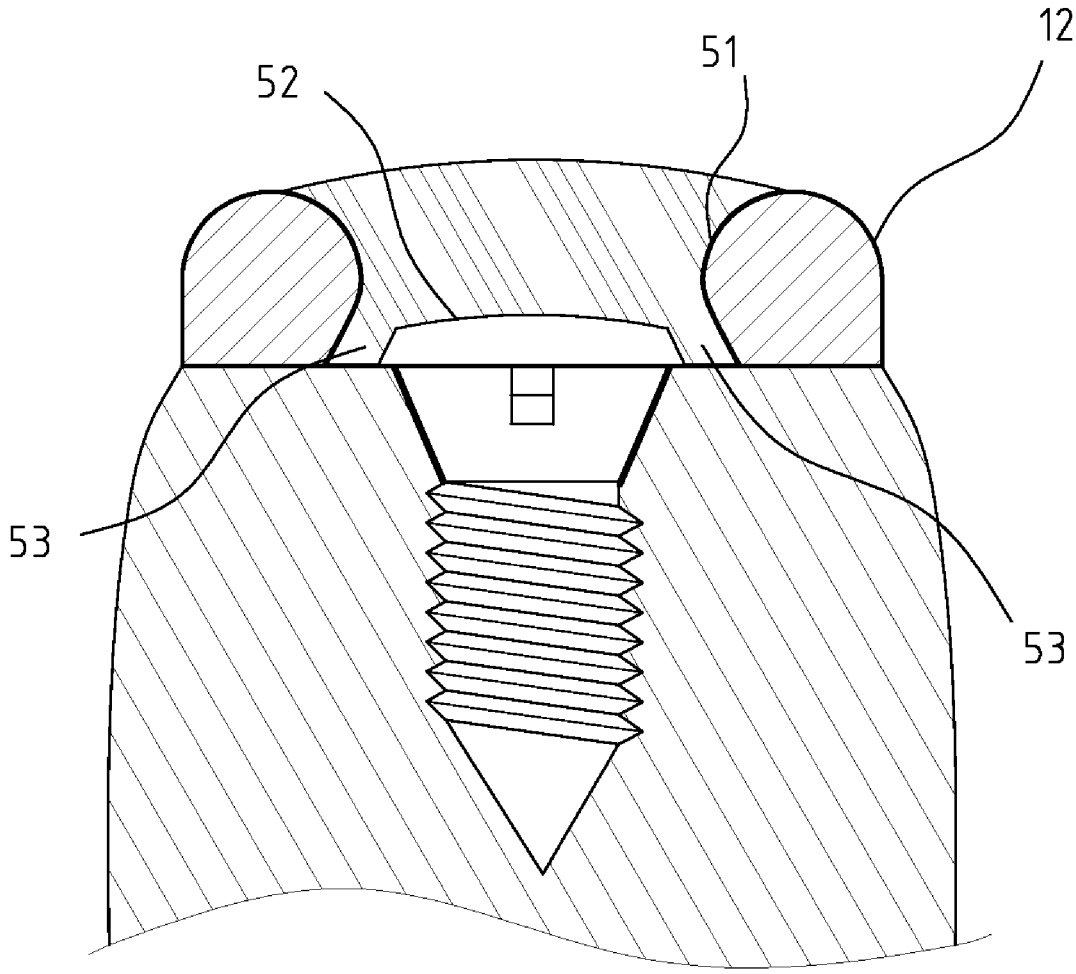

Referring to FIGS. 2A, 2B, 3, 4 and 5, a top of the backrest 4 includes a plurality of holes 41 corresponding to the holes 13 of the front leg frame 1. FIGS. 3-5 show the cross sectional views taken from the plane which is cut through by the broken line designated by V-V shown in FIG. 2. A plurality of screws 14 pass through the holes 13 and 41, and fix the backrest 4 and the front leg frame 1 together. A top of the screw 14 is screwed downward to align with the frame base 11 as shown in FIG. 4. When assembling the decoration strip 5 and the front leg frame 1 together, first of all, the decoration strip 5 is tilted to make one of the side surfaces 51 in contact with the corresponding curved ridge 12. Secondly, the decoration strip 5 is pressed downward to make another side surface 51 in contact with the corresponding curved ridge 12. Each rib 53 is fitted into the acute corner 16 between the frame base 11 and the curved ridge 12. Because of elasticity of the decoration strip 5, the decoration strip 5 can be pressed down to be fitted into the engaging groove 15 and the ribs 53 be fitted into the acute corners 16. Also because of elasticity of the decoration strip 5, the ribs 53 can be securely engaged with the acute corners 16 and the side surface 51 are in tightly contact with the curved ridges 12. Therefore, the decoration strip 5 is securely engaged with the engaging groove 15 and is not likely to fall off the engaging groove 15 of the front leg frame 1. The engaging method used by the front leg frame 1 having the decoration strip 5 engaged therein according to the present invention is more convenient and reliable to securely assemble the front leg frame 1 and the decoration strip 5 than the conventional adhesive method.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A leg frame comprising:

a frame base;

two curved ridges respectively disposed at both edges of the frame base with an engaging groove formed between the frame base and the two curved ridges, wherein an inner lower side of each curved ridge close to the frame base is slanted away from a center line of the frame base, thereby forming an acute corner between the frame base and each curved ridge; and a decoration strip being fitted in the engaging groove and having a bottom surface, two concave side surfaces, and two extended ribs respectively disposed between the bottom surface and the two concave side surfaces;

wherein the two extended ribs are respectively engaged with the two acute corners, and the two concave side surfaces are respectively in tight contact with the two curved ridges.

* * * * *